US011242658B2

(12) United States Patent
Kappel et al.

(10) Patent No.: US 11,242,658 B2
(45) Date of Patent: Feb. 8, 2022

(54) PAVER MACHINE AND A METHOD FOR PAVER SCREED HEIGHT CALIBRATION

(71) Applicant: Volvo Construction Equipment AB, Eskilstuna (SE)

(72) Inventors: Marc Kappel, Hameln (DE); Anton Mahler, Wennigsen (DE)

(73) Assignee: Volvo Construction Equipment AB, Eskilstuna (SE)

( * ) Notice: Subject to any disclaimer, the term of this patent is extended or adjusted under 35 U.S.C. 154(b) by 48 days.

(21) Appl. No.: 16/957,842

(22) PCT Filed: Jan. 3, 2018

(86) PCT No.: PCT/EP2018/050132
§ 371 (c)(1),
(2) Date: Jun. 25, 2020

(87) PCT Pub. No.: WO2019/134744
PCT Pub. Date: Jul. 11, 2019

(65) Prior Publication Data

US 2021/0062440 A1 Mar. 4, 2021

(51) Int. Cl.
*E01C 19/48* (2006.01)

(52) U.S. Cl.
CPC ..... *E01C 19/4873* (2013.01)

(58) Field of Classification Search
CPC ..... E01C 19/4873
USPC ..... 404/72, 84.05, 84.1, 118
See application file for complete search history.

(56) References Cited

U.S. PATENT DOCUMENTS 4,026,658 A 5/1977 Neuendorf et al.
5,365,442 A * 11/1994 Schmidt ..... A01B 63/114 37/348
8,079,776 B2 * 12/2011 Lossow ..... E01C 19/48 404/84.5
8,267,619 B2 * 9/2012 Munz ..... E01C 19/48 404/118
8,282,312 B2 * 10/2012 Braddy ..... E01C 23/01 404/84.05
8,944,719 B2 * 2/2015 Frelich ..... E01C 19/48 404/84.1
9,382,675 B2 * 7/2016 Frelich ..... B60L 50/52
(Continued)

FOREIGN PATENT DOCUMENTS

EP 0495171 A1 7/1992

OTHER PUBLICATIONS

International Search Report and Written Opinion of the International Searching Authority, PCT/EP2018/050132, dated Oct. 10, 2018, 12 pages.

*Primary Examiner* — Raymond W Addie
(74) *Attorney, Agent, or Firm* — Sage Patent Group

(57) ABSTRACT

A paver machine includes a screed arranged to level out road material disposed on the ground and a pressure actuated screed lifting cylinder arranged to lift and lower the screed with respect to the ground. A pressure sensor is arranged to measure the pressure in the cylinder when the screed is being lifted or lowered. Further a control unit configured to receive pressure data from the pressure sensor indicative of the pressure in the screed lifting cylinder when the screed is being lifted by the screed lifting cylinder. Based on analysing the pressure data, the control unit sets a reference height position for the screed.

20 Claims, 9 Drawing Sheets

(56) References Cited

U.S. PATENT DOCUMENTS

| | | | | |
|---|---|---|---|---|
| 9,441,334 | B1 * | 9/2016 | Frelich | E01C 19/48 |
| 10,550,529 | B2 * | 2/2020 | Jorgensen | E01C 19/48 |
| 2009/0226255 | A1 | 9/2009 | Lossow | |
| 2010/0284742 | A1 | 11/2010 | Christ et al. | |

* cited by examiner

PAVER MACHINE AND A METHOD FOR PAVER SCREED HEIGHT CALIBRATION

CROSS REFERENCE TO RELATED APPLICATIONS

This application is a 35 U.S.C. § 371 national stage application of PCT International Application No. PCT/EP2018/050132 filed on Jan. 3, 2018, the disclosures and content of which are incorporated by reference herein in their entirety.

TECHNICAL FIELD

The invention relates to a paver machine comprising a screed and to method for height calibration of the screed.

BACKGROUND

Paver machines are generally used for distributing road material such as asphalt on the ground and also provide initial compaction of the asphalt. The road material is typically provided from a truck to a hopper of the paver machine from which the road material is transported via conveyors to in front of a screed. The screed is generally arranged at the rear of the paver machine for levelling out the road material provided in front of the screed across a predetermined width such as for example the width of the road where the road material is laid.

The screed functions not only to level out the road material but also to define the layer thickness of the road material after it has been levelled out. By placing the screed at a desired height from the ground, the paving height can be adjusted accordingly.

A common type of screed is a so-called floating screed. With a floating screed, the thickness of the paved road material is adjusted by controlling the angle of attack of the screed relative the horizontal axis. A larger angle of attack results in a thicker layer of road material on the ground. The distance from the rear edge of the screed to the ground defines the paving thickness. Therefore, it would be advantageous to be able to determine the distance from the rear edge of the screed to the ground. US2009/0226255 discloses a paver comprising a floating screed. Screed-transporting cylinders are used for raising the screed in a transport position and actuating cylinders are used for moving the screed to height corresponding to a paving height dimension. The height of the screed is measured relative some reference line such as the ground or a span wire using paving height sensors.

However, determining the height with reference to the reference line requires a calibration with respect to the reference line. Such calibration is commonly done by visual inspection which is both time consuming and inaccurate.

Thus, there is a need for improving the height calibration for paver screeds.

SUMMARY

An object of the invention is to provide a paver machine comprising a screed with improved means for height calibration with respect the ground. There is further provided an improved method for screed height calibration.

The object is at least partly achieved by a paver machine according to claim 1.

According to a first aspect of the invention, there is provided a paver machine comprising: a screed arranged to level out road material disposed on the ground; a pressure actuated screed lifting cylinder connected to the screed and arranged to lift and lower the screed with respect to the ground; a pressure sensor arranged to measure the pressure in the cylinder when the screed is being lifted or lowered; a control unit configured to: receive pressure data from the pressure sensor indicative of the pressure in the screed lifting cylinder when the screed is being lifted by the screed lifting cylinder; determine a variation in at least a portion of the pressure data indicative of a pressure variation in the cylinder, when the variation is determined to be within a predetermined stability variation threshold, set a reference height position for the screed based on the present position of the screed.

The present invention is based on the realization that the pressure variations in the screed lifting cylinders can be analysed in order to determine that the screed is in a position where it just left the ground which defines an advantageous reference height position. It was realized that the pressure condition in the screed lifting cylinders changes at the moment when the screed is lifted off the ground.

By the provision of analysing the pressure conditions in the screed lifting cylinders, the invention provides the advantage that a reference height for the screed can be automatically determined based on the pressure conditions in the screed lifting cylinder.

The screed may be a floating screed which means that in operation during paving, the screed floats on the road material. The paving height is determined by the angle of attack and the height from the ground of the trailing edge of the screed, in the rear-most location of the screed. The floating screed is arranged in a rear location of the paver machine. The angle of attack depends at least partly on the weight of the screed and the temperature of the road material. When the angle of attack is changed, the floating screed "floats" up or down on the pile of road material disposed in front of the floating screed. The paving width is determined by the width of the screed.

The pressure actuated screed lifting cylinder may for example be a pneumatic cylinder or hydraulic cylinder, and operates by increasing or decreasing the pressure of a gaseous medium (e.g. air) or a liquid (e.g. oil) in a cylinder to apply a force on a piston configured to move in the cylinder bore. The piston is connected to a piston rod which extends to the outside of the cylinder bore. One of the cylinder side or the piston rod side is connected to the screed or to a screed lifting arm and the other side is connected to a point on the paver machine main body, e.g. the frame of the chassis of the paver machine.

The screed may be pivotally connected to a screed lifting arm which may be pivotally connected to the screed lifting cylinder. Further, the screed lifting cylinder may be pivotally connected to the paver machine chassis or another suitable paver machine part. The pressure actuated screed lifting cylinder is arranged such that when it applies a force on the screed lifting arm, the screed lifting arm pivots about a pivotal connection such that the screed is lifted. The screed lifting cylinder may also cause the screed lifting arm to pivot in the opposite direction.

The reference height position is known to the control unit by the present state of the pressure actuated screed lifting cylinder at the moment the reference height position is determined. The present state of the pressure actuated screed lifting cylinder may relate to the present length of the screed lifting cylinder including the cylinder bore and how far out the piston rod of the cylinder is from the bore of the cylinder. Since the screed lifting cylinder lifts or lowers the screed by moving the piston rod in or out of the cylinder bore, the total length of the cylinder (bore plus piston rod outside of the bore) at any given time relates to the position of the screed. Accordingly, with knowledge of the geometry of the screed and the screed lifting arm, and the present state of the screed lifting cylinder(s), the control unit may calculate the present position of the screed.

The pressure sensor may be a strain gauge based pressure sensor such as a thick-layer DMS on a ceramic diaphragm, or a thin-film DMS on a stainless steel diaphragm.

Moreover, it may also be possible to use load cells for determining the pressure in the cylinder. With a load cell, the pressure is determined indirectly by first determining a force applied on the load cell located either between the pressure actuated screed lifting cylinder and the screed or between the pressure actuated screed lifting cylinder and the main body of the paver machine. Either way, the load cell is arranged to measure a force exerted on the cylinder by the screed. The measure force is related to the pressure in the screed lifting cylinder.

In one embodiment the pressure actuated screed lifting cylinder may be a hydraulic cylinder, wherein the pressure sensor is integrated with the screed lifting hydraulic cylinder.

The pressure sensor measures the pressure in the cylinder and produces pressure data which is received by a control unit. The pressure data may be a series of data points indicative of the pressure over a time period.

The variation in the pressure data may be a differential between data points in the pressure data. The variation may alternatively be a differential between averages of data points, for example the differential between an average of a first plurality of data points and an average of a second plurality of data points.

The variation is preferably required to be within the predetermined stability variation threshold for a predetermined time duration. This may be determined by determining the differential between the maximum pressure (single point or an average) and the minimum pressure (single point or an average) measured over the predetermined time duration. This measurement may be performed continuously over a running window given by the predetermined time duration in the acquired pressure data. Only when the difference between the maximum and minimum is within the stability variation threshold for the predetermined time duration is the reference height position set.

The stability variation threshold may correspond to about 10 bar which is an acceptable variation that indicates that the screed is off the ground.

Accordingly, at the moment when the pressure is determined to be stable, i.e. within the variation threshold for the predetermined time duration, then the present position of the screed is set as the reference height position. As will be explained, the pressure in the cylinder is stabilized when the screed is completely lifted off the ground.

According to one embodiment, the variation in the pressure data is determined in response to that an increase in pressure has been detected in the pressure data, the increase in the pressure is indicative that the screed is being lifted off the ground. Hereby an advantageous way to determine that the screed is being lifted off the ground is provided which is based on analysing the pressure conditions in the screed lifting cylinder without the need for external additional means for determining a screed lifting action. The increase in pressure may be determined by analysing a plurality of data points over a time window to establish that an increase in pressure has occurred. Thus, the increase is preferably a pressure increase which occurs over a plurality of data points in the time window and not only an increase between two consecutive data points. The pressure increase provides the initial lifting force for initiating the lifting the screed off the ground and may thus be used as an indication that the screed is being lifted. Once the pressure is stabilized, the screed is completely off the ground.

The pressure sensor may be arranged on the piston rod side of the pressure actuated screed lifting cylinder, at least if the piston rod side is attached to the screed. Measuring the pressure on the side of the pressure actuated screed lifting cylinder that is connected to the screed provides a more accurate pressure measurement than connection the pressure senor to the opposite side (not connected to the screed) of the screed lifting cylinder.

In one embodiment, the paver machine may comprise a memory storage device, wherein the control unit is configured to store the reference height position in the memory storage device. Hereby, the control unit can advantageously access the reference height position for calculating paving height, or for raising the screed to a desired height over the ground.

In embodiments of the invention, the paver machine may comprise a first pressure actuated screed lifting cylinder and a second pressure actuated screed lifting cylinder, each of the pressure actuated screed lifting cylinders has an associated pressure sensor, wherein the control unit is configured to determine a variation in pressure data for each of the pressure actuated screed lifting cylinders to thereby set a reference height position for the screed. Hereby, it is possible to determine a reference height position at two locations of the screed, one for each of the screed lifting cylinders. This advantageously provides the possibility to determine a reference height position on road surfaces that have a cross-wise slope. The first and the second screed lifting cylinder may be arranged in line with each other, at the same distance from the trailing edge of the screed. In other words, the first and the second screed lifting cylinder may be symmetrically arranged on the paver machine in a side-wise (left-right) perspective. Further, the pressure actuated screed lifting cylinders may be arranged at the rear of the paver machine.

The paver machine is preferably a tracked paver.

The reference height position is a zero height position for the screed indicative of the screed height position when the screed is in contact with the ground. Hereby, an advantageous zero level is set from which a height of the screed may be directly determined as the deviation from the zero level.

According to a second aspect of the invention, the object is achieved by a paver machine according to claim 11.

According to the second aspect of the invention, there is provided a paver machine comprising: a screed arranged to level out road material disposed on the ground; a pressure actuated screed lifting cylinder arranged to lift and lower the screed with respect to the ground; a pressure sensor arranged to measure the pressure in the cylinder when the screed is being lifted or lowered; a control unit configured to: receive pressure data from the pressure sensor indicative of the pressure in the screed lifting cylinder when the screed is being lowered by the screed lifting cylinder; determine a variation in at least a portion of the pressure data indicative of a pressure variation in the cylinder, when the variation is determined to exceed a variation threshold, set a reference height position for the screed based on the present position of the screed.

The present invention is further based on the realization that the pressure variations in the screed lifting cylinders can be analysed in order to determine that the screed is in a position where it touches the ground which defines an advantageous reference height position. It was realized that the pressure condition in the screed lifting cylinders changes at the moment when the screed touches the ground.

Accordingly, by the provision of analysing the pressure conditions in the screed lifting cylinders, the invention provides the advantage that a reference height for the screed can be automatically determined based on the pressure conditions in the screed lifting cylinder.

When the screed is in a lifted position, the pressure in the screed lifting cylinder is relatively stable. Further, also when the screed is being lowered is the pressure relatively stable in the screed lifting cylinder. However, at the time when the screed touches the ground, the pressure in the screed lifting cylinder changes since the contact with the ground relieves the screed lifting cylinder from some of the load. Thereby, a variation in the pressure can be determined and be indicative of that the screed touched ground.

Accordingly, the variation may be a variation in the pressure data between a stabilized pressure and a decrease in pressure, the variation being indicative of the screed touching the ground.

Similar to the first aspect, the variation may be determined from the differential between the maximum pressure (single point or an average) and the minimum pressure (single point or an average) measured over the predetermined time duration. This measurement may be performed continuously over a running window given by the predetermined time duration in the acquired pressure data. Only when the difference between the maximum and minimum exceeds the variation threshold is the reference height set.

Effects and features of the second aspect of the invention are largely analogous to those described above in connection with the first aspect.

According to a third aspect of the invention, the object is achieved by a method according to claim 19.

According to the third aspect, there is provided a method for height calibration of a screed of a paver machine, the paver machine comprising a pressure actuated screed lifting cylinder arranged to lift and lower the screed with respect to the ground, wherein the method comprises the steps of: receiving an indication that the screed is being lifted off the ground, collecting pressure data indicative of the pressure in the screed lifting cylinder when the screed is being lifted by the screed lifting cylinder; determining a variation in at least a portion of the pressure data indicative of a pressure variation in the cylinder, when the variation is determined to be within a predetermined stability variation threshold, setting a reference height position for the screed based on the present position of the screed.

In embodiments it may be included to, based on the pressure data, detecting a pressure increase for determining that the screed is being lifted off the ground before determining the variation in the pressure data.

Effects and features of the third aspect of the invention are largely analogous to those described above in connection with the first aspect and second aspect.

Furthermore, there is provided a computer program comprising program code means for performing the steps of any of the embodiments of the third aspect when the program is run on a computer.

Furthermore, there is provided a computer readable medium carrying a computer program comprising program code means for performing the steps of any of the embodiments of the third aspect when the program product is run on a computer.

Additionally, there is provided a control unit for controlling the height of a screed, the control unit being configured to perform the steps of the method according to the steps of any of the embodiments of the third aspect.

According to a fourth aspect of the invention, the object is achieved by a method according to claim 21.

According to the fourth aspect there is provided a method for height calibrating of a screed of a paver machine, the paver machine comprising a pressure actuated screed lifting cylinder arranged to lift and lower the screed, wherein the method comprises the steps of: receiving an indication that the screed is being lowered with respect to the ground, collecting pressure data indicative of the pressure in the screed lifting cylinder when the screed is being lowered by the screed lifting cylinder; determining a variation in at least a portion of the pressure data indicative of a pressure variation in the cylinder, when the variation is determined to exceed a variation threshold, setting a reference height position for the screed based on the present position of the screed.

In embodiments it may be included to detect a stabilized pressure from the pressure data, wherein the pressure variation is a decrease in pressure from the stabilized pressure, the pressure variation is an indication that the screed is touching the ground.

Effects and features of the fourth aspect of the invention are largely analogous to those described above in connection with the first aspect, second aspect, and the third aspect.

Furthermore, there is provided a computer program comprising program code means for performing the steps of any of the embodiments of the fourth aspect when the program is run on a computer.

Furthermore, there is provided a computer readable medium carrying a computer program comprising program code means for performing the steps of any of the embodiments of the fourth aspect when the program product is run on a computer.

Additionally, there is provided a control unit for controlling the height of a screed, the control unit being configured to perform the steps of the method according to any of the embodiments of the fourth aspect.

In summary, the invention relates to a paver machine comprising a screed arranged to level out road material disposed on the ground and a pressure actuated screed lifting cylinder arranged to lift and lower the screed with respect to the ground. A pressure sensor is arranged to measure the pressure in the cylinder when the screed is being lifted or lowered. Further a control unit configured to receive pressure data from the pressure sensor indicative of the pressure in the screed lifting cylinder when the screed is being lifted by the screed lifting cylinder. Based on analysing the pressure data, the control unit sets a reference height position for the screed.

Further features of, and advantages with, the present invention will become apparent when studying the appended claims and the following description. The skilled person realize that different features of the present invention may be combined to create embodiments other than those described in the following, without departing from the scope of the present invention.

BRIEF DESCRIPTION OF THE DRAWINGS

With reference to the appended drawings, below follows a more detailed description of embodiments of the invention cited as examples.

In the drawings.

DETAILED DESCRIPTION OF EXAMPLE EMBODIMENTS OF THE INVENTION

Figure 1:
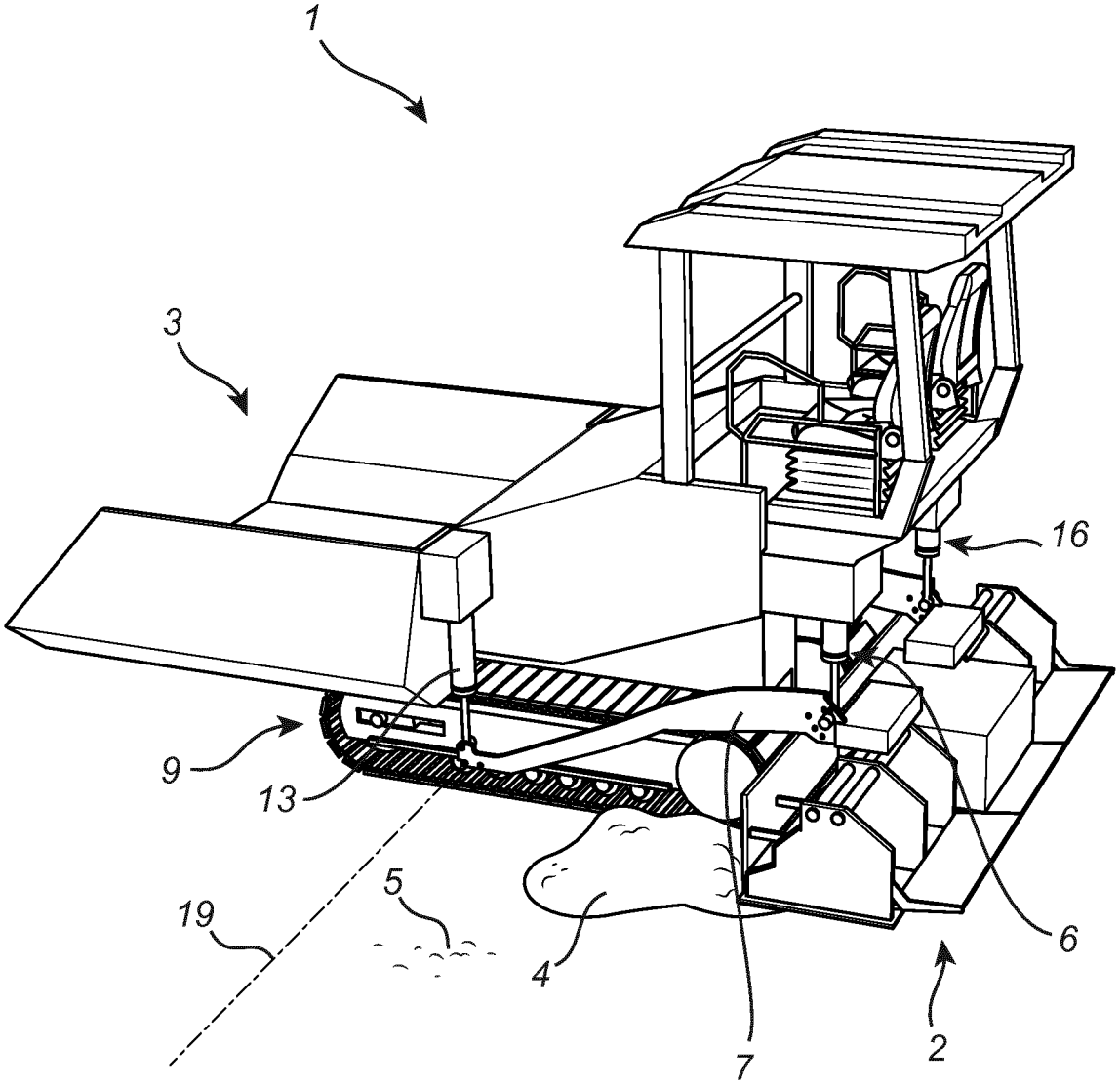
FIG. 1 is a conceptual side view of a tracked paver machine.

The present invention will now be described more fully hereinafter with reference to the accompanying drawings, in which exemplary embodiments of the invention are shown. The invention may, however, be embodied in many different forms and should not be construed as limited to the embodiments set forth herein; rather, these embodiments are provided for thoroughness and completeness. The skilled person will recognize that many changes and modifications may be made within the scope of the appended claims.

Like reference character refer to like elements throughout the description.

FIG. 1 illustrates a paver machine 1 according to embodiments of the invention. The paver is a tracked paver machine 1 which accordingly comprises caterpillar tracks 9 for providing vehicle propulsion for the paver machine 1. Furthermore, the paver machine 1 comprises a hopper 3 in which road material is temporarily stored during paving. The road material is typically added to the hopper 3 from a truck. The road material may be asphalt.

The paver machine 1 further comprises a screed 2 arranged at the rear of the paver machine 1. The screed 2 is arranged to level out road material 4 disposed on the ground 5 in front of the screed 2. The road material 4 has been transported from the hopper 3 to the ground via conveyor belts (not shown).

The screed 2 may further comprise an auger (not shown) for distributing the road material across the width of the screed 2 such that a desired paving width may be covered with road material.

A pressure actuated screed lifting cylinder 6 is arranged to lift and lower the screed 2 with respect to the ground 5. The pressure actuated screed lifting cylinder 6 is connected to a screed lifting arm 7.

The screed lifting arm 7 is connected to the screed 2 at an end portion of the lifting screed lifting arm 7. A further pressure actuated screed lifting cylinder 13 is arranged further to the front of the paver machine 1 than the pressure actuated screed lifting cylinder 6. The pressure actuated screed lifting cylinder 13 is pivotally connected to the screed lifting arm 7 at its other end portion. In the presently described example embodiment, the piston rod of the pressure actuated screed lifting cylinders 6, 13 is pivotally connected to the screed lifting arm 7. The front pressure actuated screed lifting cylinder 13 may be maintained in one position when lowering or lifting the screed using the rear pressure actuated screed lifting cylinder 6. In this way, the pressure actuated screed lifting cylinders 6 and 13 may thus cooperate to cause the screed lifting arm 7 to rotate about a pivot axis 19 which thereby enables lifting or lowering the screed 2 with respect to the ground 5.

Figure 2:
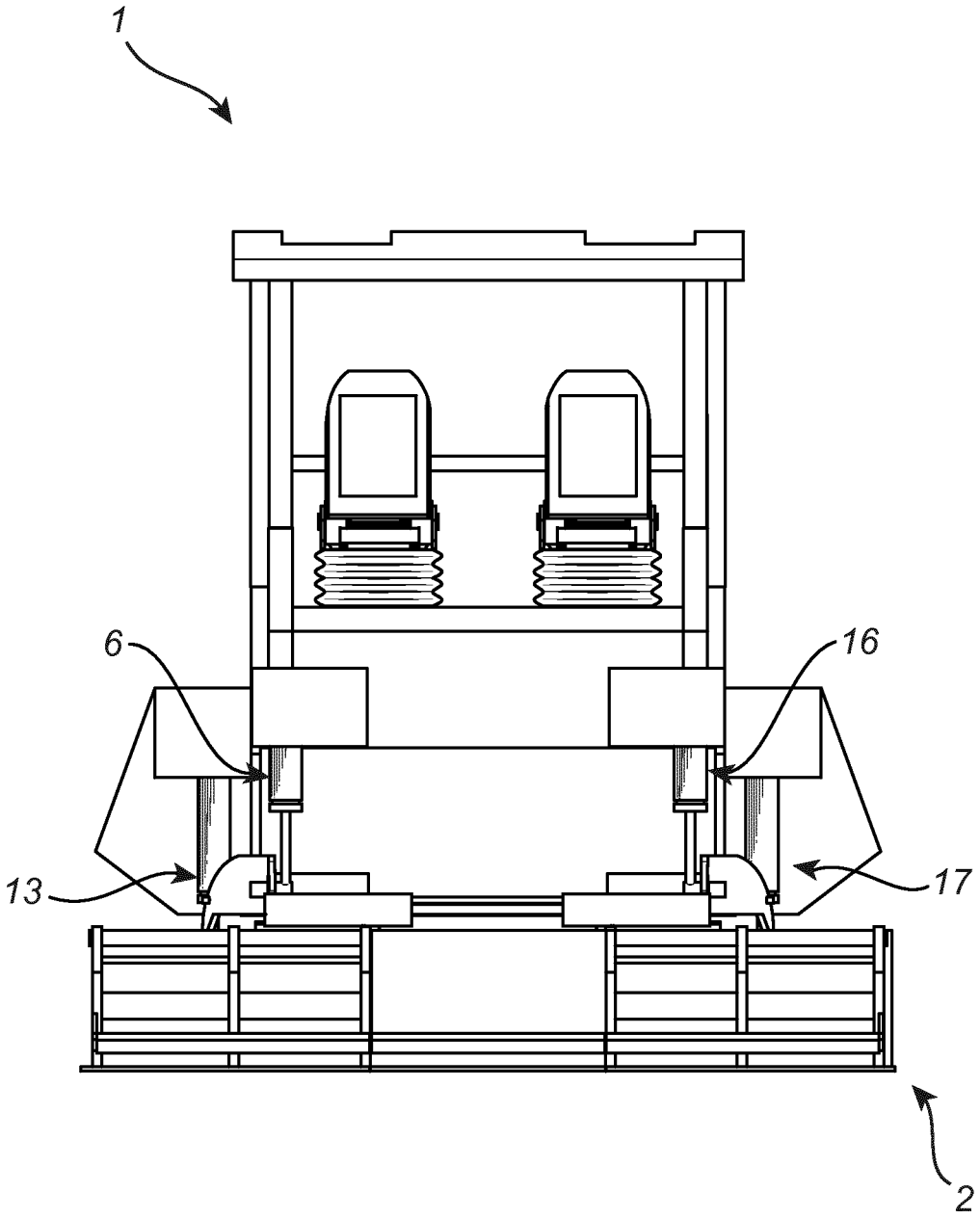
FIG. 2 is a conceptual rear view of the tracked paver machine in FIG. 1.

FIG. 2 illustrates the rear side of the paver machine 1. In FIG. 2 there is schematically illustrated that the paver machine 1 comprises two rear pressure actuated screed lifting cylinders 6 and 16 arranged on the left and the right side of the paver machine 1, respectively. Further, the paver machine 1 comprises two front pressure actuated screed lifting cylinders 13 and 17 arranged on the left and the right side of the paver machine 1, respectively. The screed lifting cylinders are preferably pivotally attached to the main body of the paver machine 1.

Figure 3:
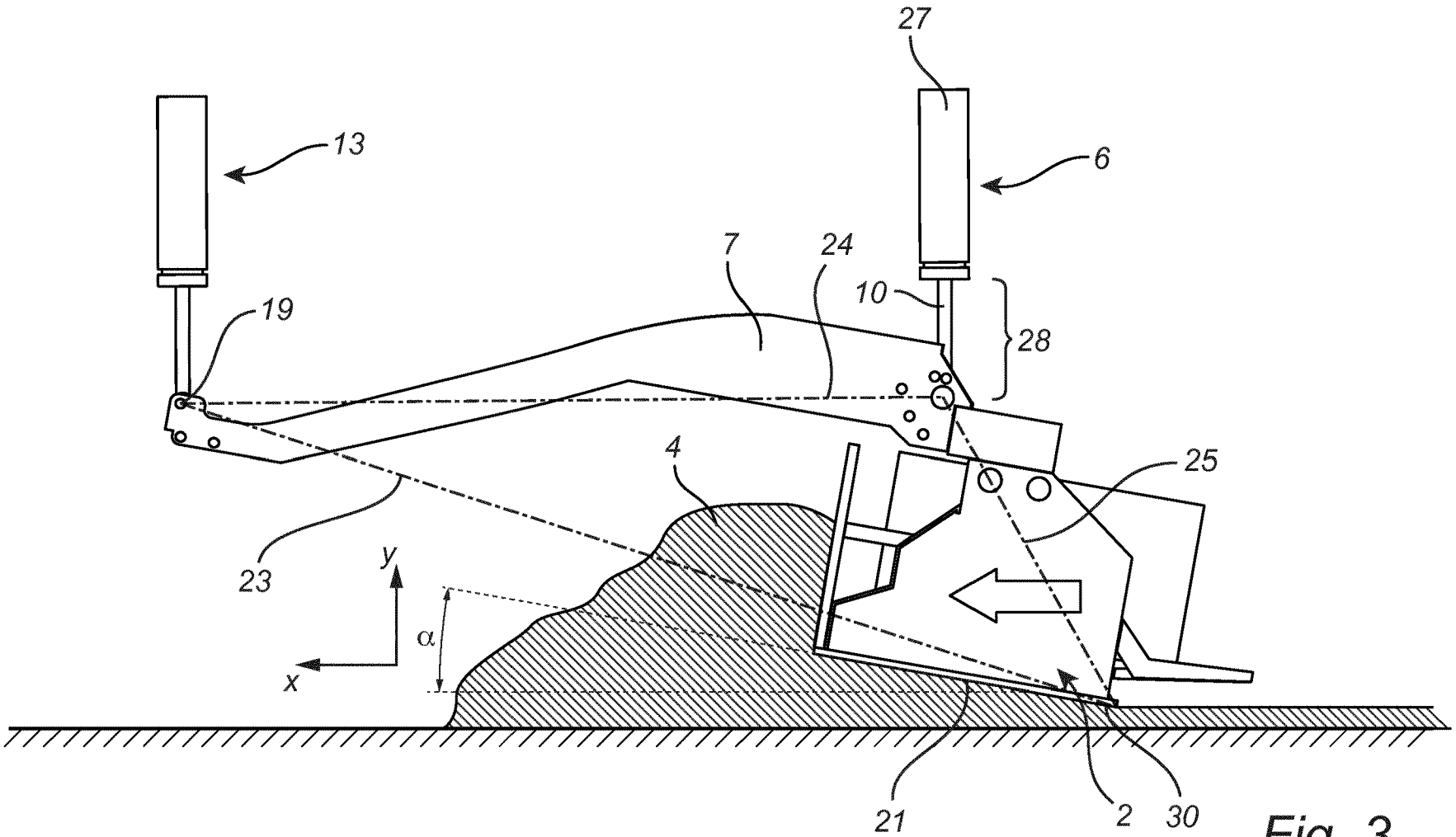
FIG. 3 is a conceptual side view of a screed attached to a screed lifting arm, FIG. 4*a-e* conceptually illustrates the functionality of embodiments of the invention, FIG. 5*a-d* conceptually illustrates the functionality of further embodiments of the invention.

FIG. 3 schematically illustrates a side view of screed 2 connected to a screed lifting arm 7 which is connected to pressure actuated screed lifting cylinders 6 (rear cylinder) and 13 (front cylinder). The cylinders 6 and 13 may apply forces to the screed lifting arm 7 to cause it to rotate about the pivot axis 19 to thereby lift or lower the screed 2 with respect to the ground 5. As mentioned above, the screed lifting arm 7 may be pivotally attached to the paver machine main body such that it may rotate about the axis 19. The screed 2 is arranged at an angle of attack a with respect to the ground which makes the screed float in the pile of road material 4 placed in front of the screed 2. The screed 2 comprises a screed plate 21 which is in contact with the road material when paving which provides initial compaction on the road material.

FIG. 4*a-e* conceptually illustrates the functionality of embodiments of the invention. First with reference to FIG. 4*a-d*, a conceptual screed 2 is illustrated as it is lifted from the ground 5. A rear screed lifting pressure actuated cylinder 6 is arranged to lift and lower the screed 2 with respect to the ground 5.

Figure 4A:
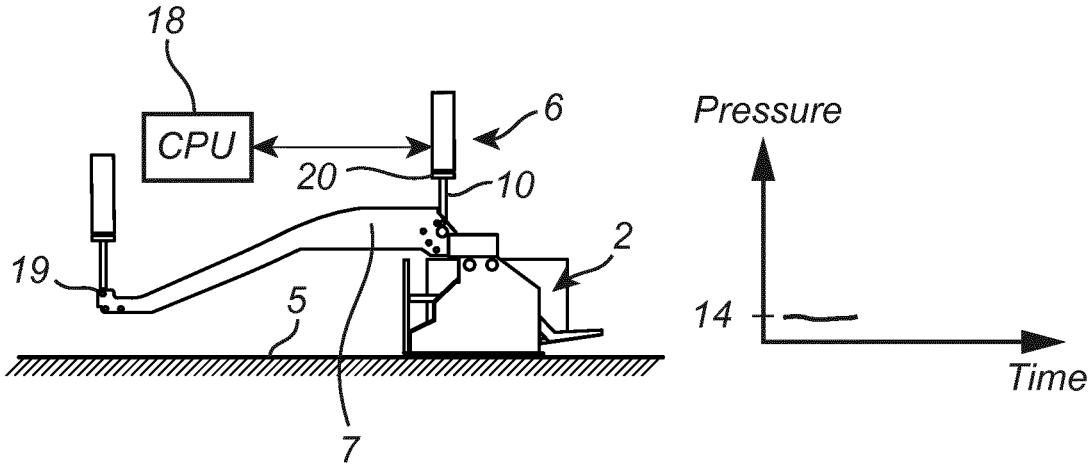
Figure 4B:
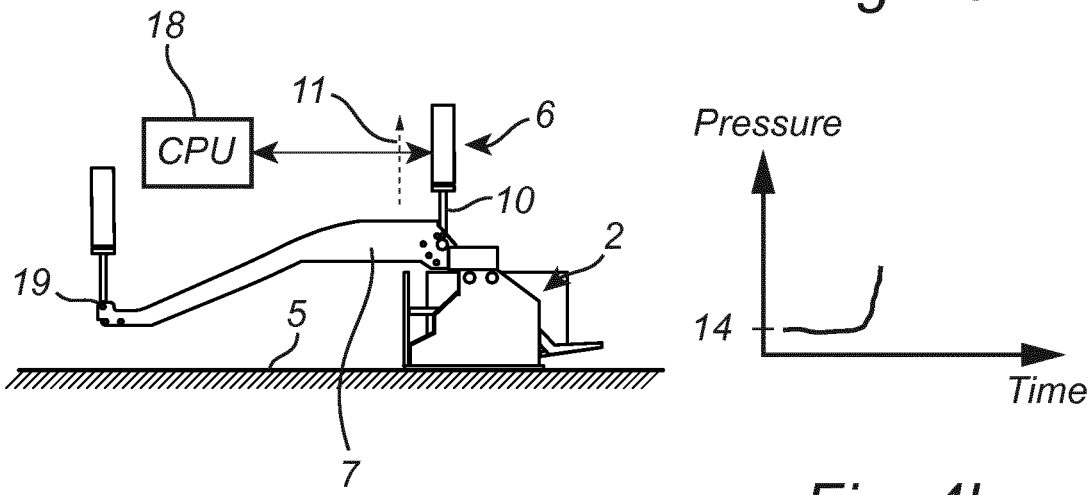
Figure 4C:
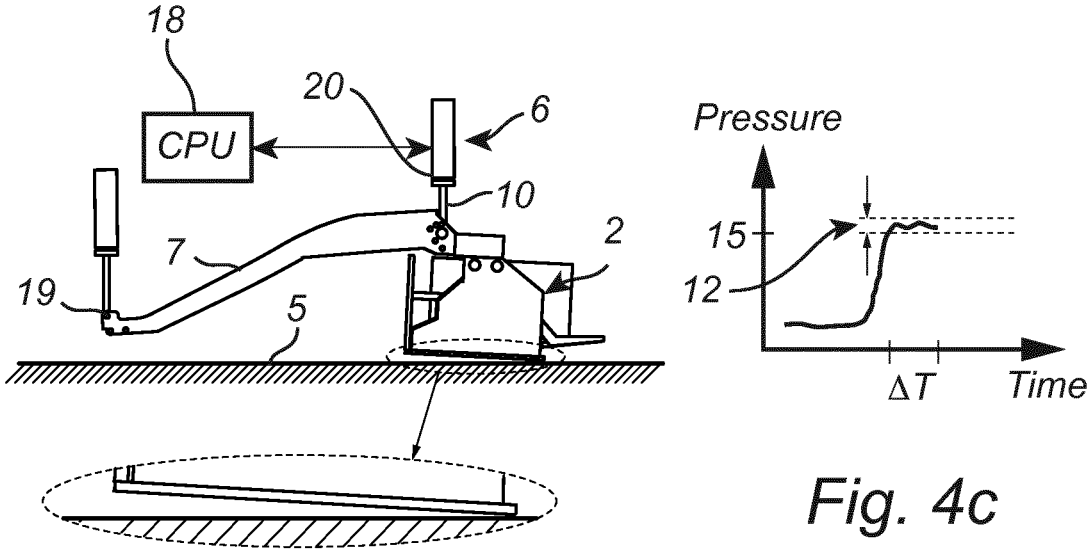
Figure 4D:
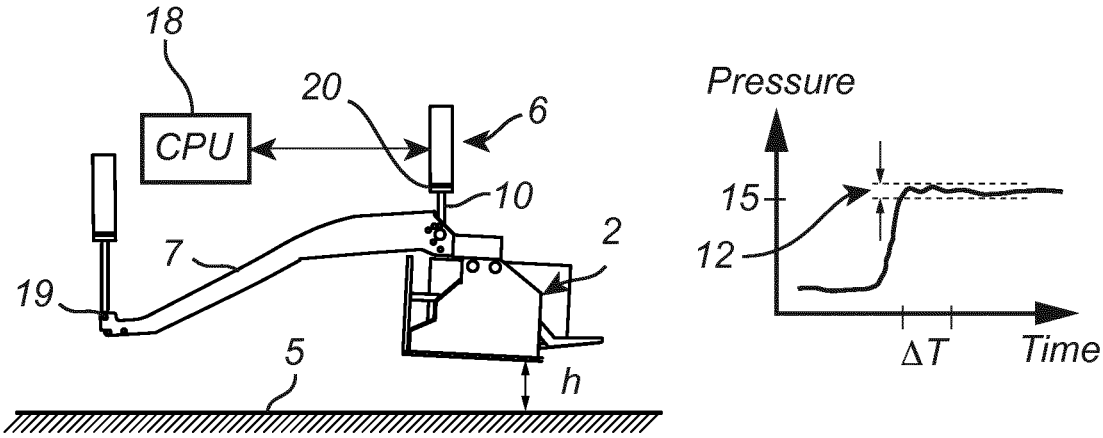

In FIG. 4*a*, the screed 2 is shown to be resting on the ground 5. Thus, the screed lifting cylinder 6 does not have to apply pressure to maintain the position of the screed and consequently the pressure is at a relatively low level 14 as shown in the pressure versus time graph. As illustrated in FIG. 4*b*, the screed 2 is now caused to be lifted by the screed lifting cylinder 6 in the direction indicated by the arrow 11. In this moment the pressure is increasing in the screed lifting cylinder 6 to be able to lift the screed 2 off the ground 5. With reference to FIG. 4*c*, once the screed loses contact with the ground the pressure does no longer have to be increased and is thus stabilized at an offset level 15. The pressure is maintained at the relatively stable pressure level 15 when the screed 2 if lifted further as illustrated in FIG. 4*d*.

The control unit 18 (conceptually illustrated in FIGS. 4*a-d*) is configured to receive pressure data from a pressure sensor 20 (only conceptually illustrated) arranged to measure the pressure in the screed lifting cylinder 6. The control unit 18 analyses the pressure data and determines a variation of the pressure data over a predetermined time duration $\Delta T$. With further reference to FIG. 4*c*, once the variation in the pressure data over the time duration $\Delta T$ is below a predetermined stability variation 12 is the present position of the screed set as a reference height position for the screed 2. Accordingly, the present position of the screed 2 when it has just lost contact with the ground 5 will be set as a reference height position for the screed. As conceptually illustrated in FIG. 4*d*, the ground level may provide a reference for the screed position, such that a height (h) of the screed from the ground 5 can be determined. The time duration $\Delta T$ may be a running window that such that the variation calculation is continuously over the running window.

With reference again to FIG. 3, a position of the screed may be calculated by the control unit 18 based on the geometry of the screed and the state of the screed lifting cylinder(s). The geometry relates to the relation between the locations of the screed lifting cylinders 6 and 13 and the trailing edge 30 (i.e. a location on the screed where the height is desirable to gain knowledge of). The dashed lines 23, 24, and 25 schematically indicated the geometry that the control unit may be pre-programmed to take into account for when determining a position of the screed. The geometry includes the distance (indicated by line 24) between the points where the screed lifting cylinders 13 and 6 are attached to the screed lifting arm 7, and the distances 25 and 23 between each screed lifting cylinder 6 and 13, respectively. The state of the screed lifting cylinders may be the length of the cylinder including the length of the cylinder bore 27 and the length 28 of the part of the piston rod 10 being expelled from the cylinder bore 27 for each of the screed lifting cylinders, only specifically indicated for one (6) of the screed lifting cylinders here.

Figure 4E:
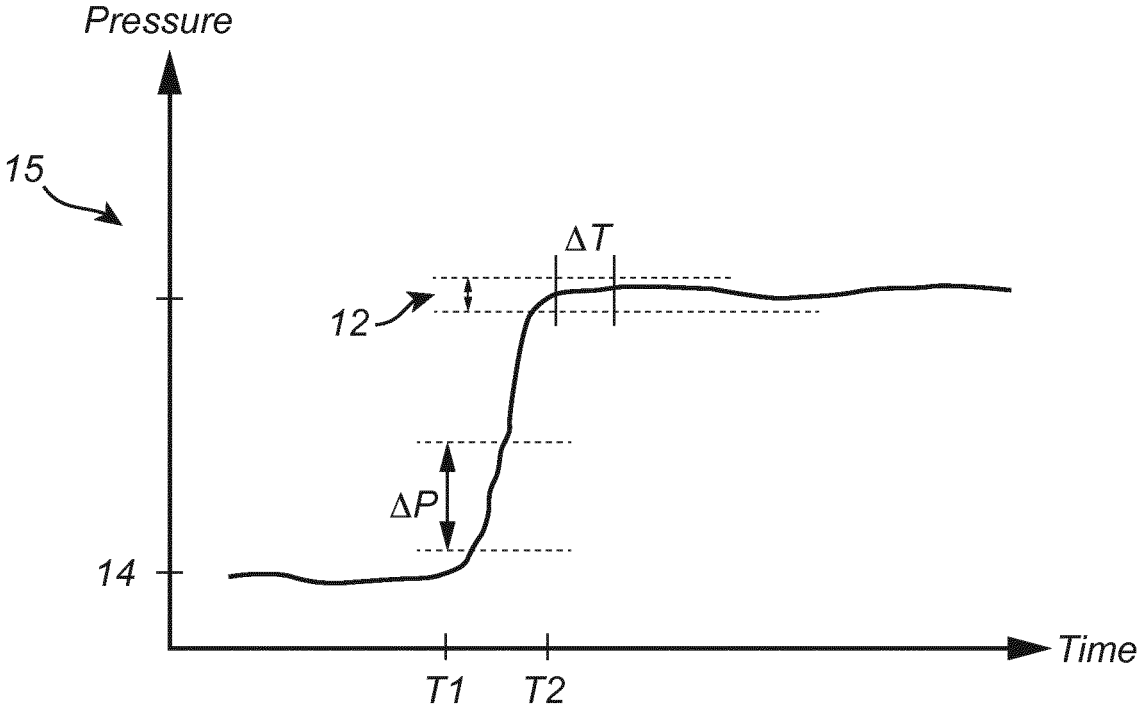

FIG. 4*e* illustrates the pressure data (see also FIGS. 4*a-d*) collected starting from that the screed 2 is resting on the ground when the pressure in the screed lifting cylinder 6 is at the relatively low level 14. A time T1 the pressure in the screed lifting cylinder 6 builds up in order to be able to lift the screed 2 off the ground. At time T2 the pressure starts to stabilize which is indicative of that the pressure in the screed lifting cylinder 6 is sufficient to lift the screed 2 off the ground. When the pressure is determined to be stable after the lifting has been initiated at T1, the reference height position for the screed 2 is set. That the screed is being lifted can be determined by the control unit from a signal received from a control system for the screed 2. However, it is also possible to analyse the pressure conditions in the screed lifting cylinder 6 to determine that the screed is being lifted as will be described next.

The increase in the pressure starting at T1 may be detected by analysing the pressure data form the pressure sensor 20. Accordingly, a variation in the pressure data is determined and if that variation exceeds a threshold increase (ΔP) it may be determined that the screed is being lifted from a position where the screed 2 is resting on the ground. The variation of pressure should exceed the threshold ΔP over a predetermined time duration, such as corresponding to a time duration from T1 to T2. This variation in pressure may thus serve as an indication that the screed is being lifted. Also in this case may the time duration be a running window.

After it has been established that the screed 2 is being lifted, the control unit may start determining the variation in the subsequent pressure data and to compare the variation with a predetermined stability threshold 12 as described above. When the variation in pressure data is within the stability threshold 12 for at least a time duration ΔT, then the present position of the screed 2 is set as a reference height position.

Figure 5A:
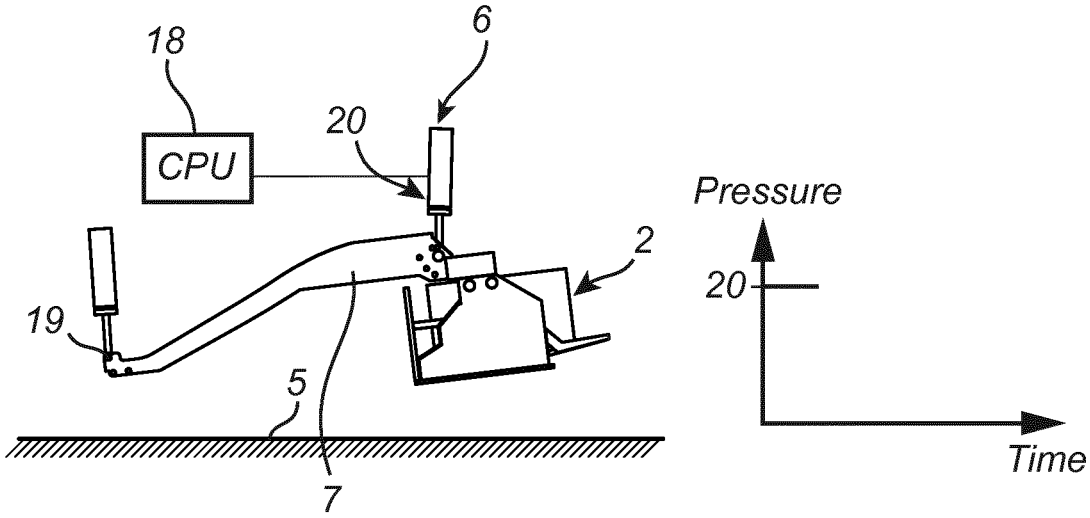
Figure 5B:
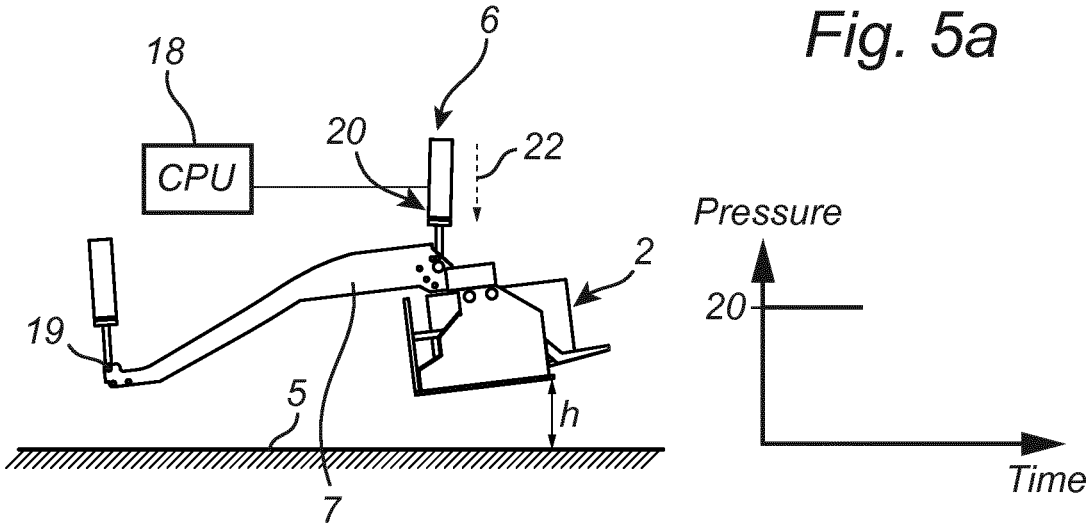
Figure 5C:
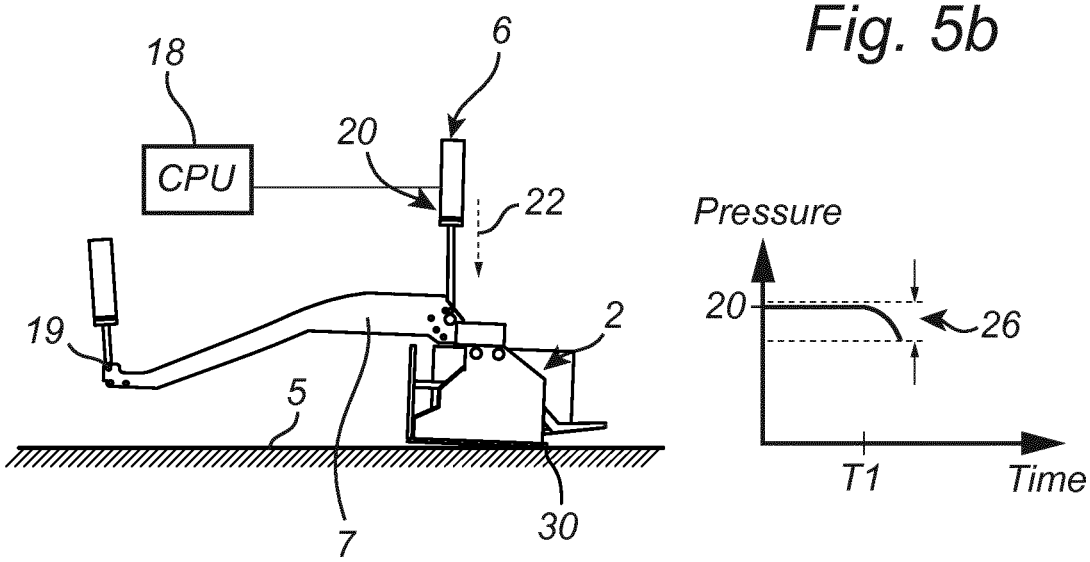

FIG. 5*a-c* conceptually illustrates further embodiments of the invention. In FIG. 5*a-c* a conceptual screed 2 is illustrated as it is lowered towards the ground 5. A rear screed lifting pressure actuated cylinder 6 is arranged to lift and lower the screed 2 with respect to the ground 5.

Initially and as conceptually illustrated in FIG. 5*a*, when the screed 2 is completely off the ground the pressure in the screed lifting cylinder 6 is relatively stable. Since the screed lifting cylinder 6 has to carry the screed at a height off the ground in FIG. 5*a*, the pressure is relatively stable and at a relatively high level 20 (see the graph in FIG. 5*a*). FIG. 5*b* illustrates the screed 2 as it is being lowered towards the ground 5 in the direction 22 by the screed lifting cylinder 6. The pressure is still maintained at the relatively high level 20. In FIG. 5*c* the screed is shown as it touches the ground at the trailing edge 30 of the screed 2 at time T1. Accordingly, at time T1 the pressure in the screed lifting cylinder 6 is reduced since the screed 2 is now touching the ground 5 and less pressure is required in the screed lifting cylinder 6 to carry the weight of the screed 2. At this point, the control unit 18 (conceptually illustrated) which receives pressure data from a pressure sensor 20 arranged to measure the pressure in the screed lifting cylinder 6 may determine that a pressure variation in the pressure data exceeds a variation threshold 26. The exceeding of the variation threshold 26 is indicative of that the screed 2 is touching the ground 5, whereby the present position of the screed 2 is set as a reference height position. The reference height position is subsequently used for determining the height of the screed from the reference height position. The reference height position is the position of the screed when it touches the ground. Accordingly, the height of the screed 2 from the ground 5 may be determined.

Figure 5D:
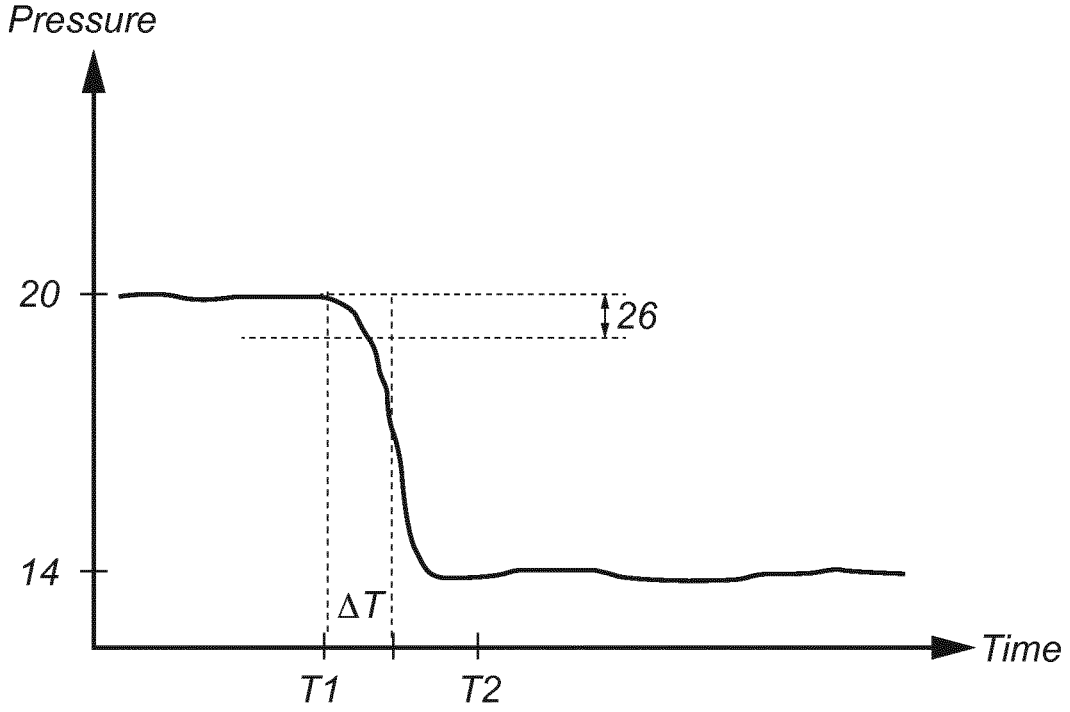

FIG. 5*d* illustrates the pressure data (see also FIGS. 5*a-c*) collected starting from that the screed 2 is in a lifted position supported by the screed lifting cylinder 6 and the pressure is a the relatively high level 20. At time T1 a pressure decrease is started as a result of that the screed 2 touches the ground (see FIG. 5*c*). That the screed is being lowered can be determined by the control unit from a signal received from a control system for the screed. However, it is also possible to analyse the pressure conditions in the screed lifting cylinder for determine that the screed 2 is being lifted.

As schematically illustrated in FIG. 5*d*, the pressure in the screed lifting cylinder is relatively stable until time T1 when the screed touches the ground. Accordingly, it may firstly be determined that the pressure is stable as described above, e.g. with reference to FIG. 4*c-e*. If the stable pressure at the relatively high pressure level 20 is followed by a decrease in pressure (over a time duration ΔT) relative the stable level 20 (FIG. 5*c*), the decrease exceeding a threshold 26 then it may first be concluded that the screed 2 has been lowered, and at the same time it can be concluded that the screed 2 has touched the ground 5 and a reference height position may be set. In this way, the reference height position will be the position of the screed when it touches the ground 5.

In some possible implementations any of the above described methods for determining a reference height position may be performed on each of the rear screed lifting cylinders 6, 16 in FIG. 2. In this way it is possible to determine a reference height position on both the left side (cylinder 6) and on the right side (cylinder 16) of the screed 2, which advantageously takes into account any cross-wise slope of the ground. In FIG. 2, the first 6 and the second screed lifting cylinder 16 are symmetrically arranged on the paver machine 1 in a side-wise (left-right) perspective.

Figure 6:
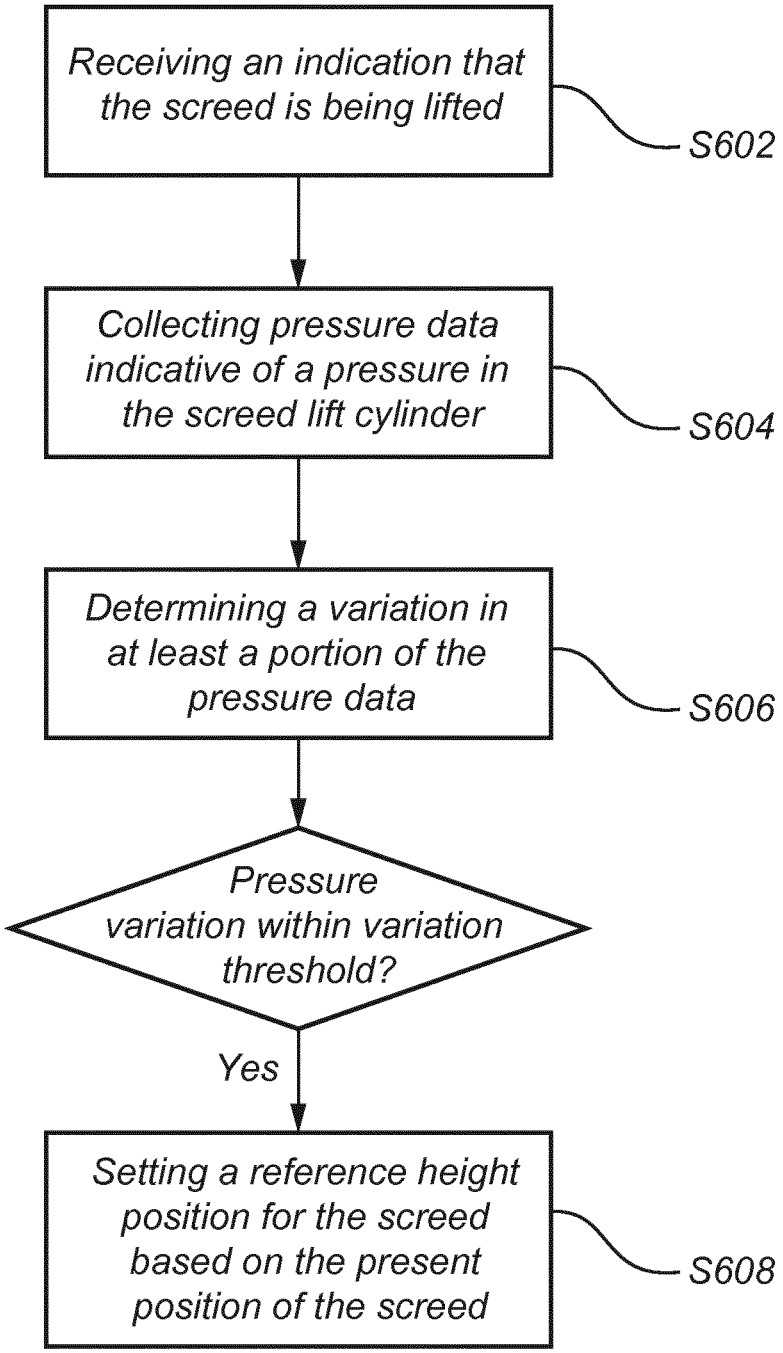
FIG. 6 is a flow-chart of method steps according to embodiments of the invention.

FIG. 6 is a flow-chart of method steps according to an embodiment of the invention. The method is for height calibration of a screed of a paver machine comprising a pressure actuated screed lifting cylinder arranged to lift and lower the screed with respect to the ground. In step S602 is an indication that the screed is being lifted off the ground received. The indication may be received from a screed control system or it may be based on detecting a pressure increase in the pressure actuated screed lifting cylinder. Pressure data indicative of the pressure in the screed lifting cylinder when the screed is being lifted by the screed lifting cylinder is collected in step S604. In step S606 is a variation in at least a portion of the pressure data indicative of a pressure variation in the cylinder determined. When the variation is determined to be within a predetermined stability variation threshold a reference height position is set S608 for the screed based on the present position of the screed.

Figure 7:
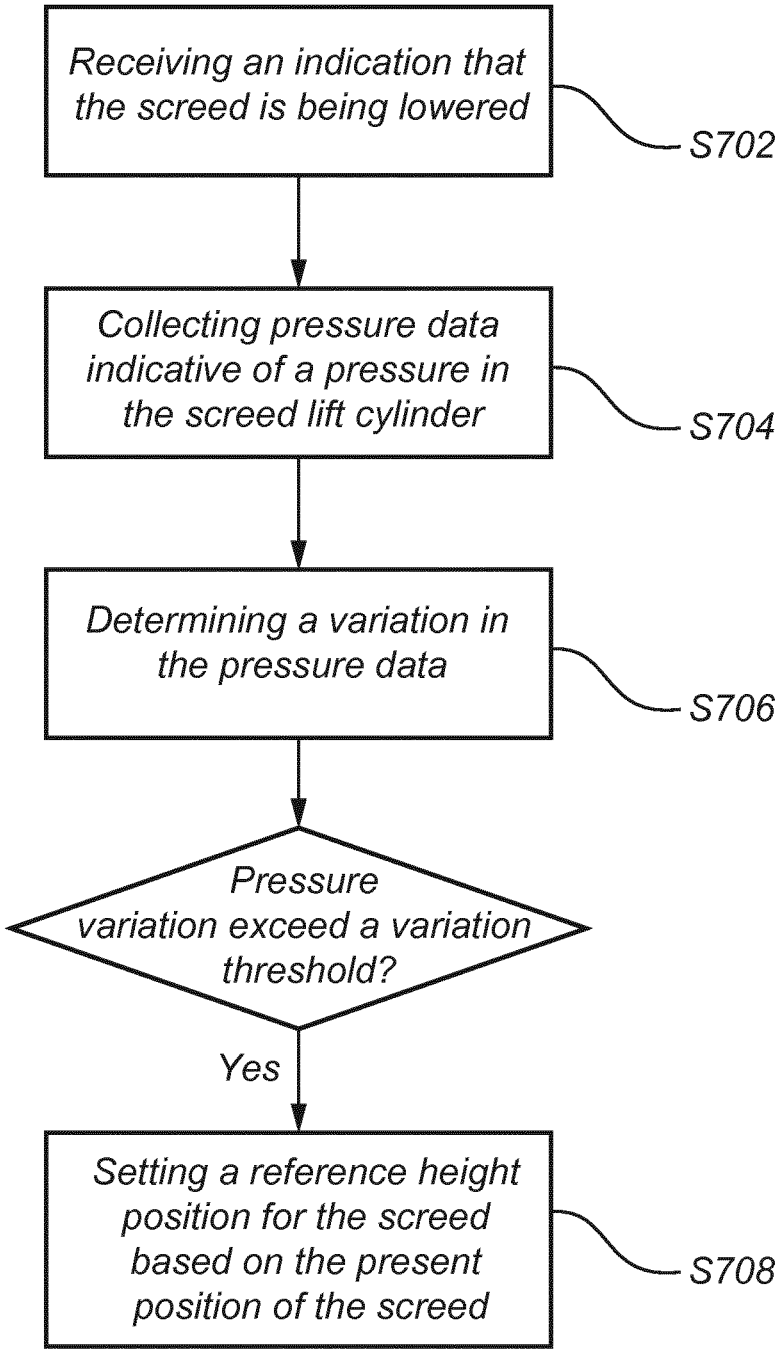
FIG. 7 is a flow-chart of method steps according to embodiments of the invention.

FIG. 7 is a further flow-chart of method steps according to a further embodiment of the invention. In step S702 an indication that the screed is being lowered with respect to the ground is received. This indication may be received from a screed control system or it may be based on detecting that the pressure in the pressure actuated screed lifting cylinder changes from a stable pressure to a decreased pressure. Pressure data indicative of the pressure in the screed lifting cylinder when the screed is being lowered by the screed lifting cylinder is collected in step S704. A variation in at least a portion of the pressure data indicative of a pressure variation in the cylinder is determined in step S706. When the variation is determined to exceed a variation threshold, a reference height position for the screed is set S708 based on the present position of the screed.

The control unit (e.g. control unit 18) may include a microprocessor, microcontroller, programmable digital signal processor or another programmable device. Thus, the control unit 18 may comprise electronic circuits and connections (not shown) as well as processing circuitry (not shown) such that the control unit 18 can communicate with different parts of the paver machine 1 such as the brakes, driveline, in particular a combustion engine, an electric machine, a clutch, and a gearbox in order to at least partly operate the paver machine 1. The control unit 18 may comprise modules in either hardware or software, or partially in hardware or software and communicate using known transmission buses such as CAN-bus and/or wireless communication capabilities. The processing circuitry may be a general purpose processor or a specific processor. The control unit 18 may comprise a non-transitory memory for storing computer program code and data upon. Thus, the skilled addressee realizes that the control unit 18 may be embodied by many different constructions.

The control functionality of the present disclosure may be implemented using existing computer processors, or by a special purpose computer processor for an appropriate system, incorporated for this or another purpose, or by a hardwire system. Embodiments within the scope of the present disclosure include program products comprising machine-readable medium for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures may show a sequence the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps. Additionally, even though the invention has been described with reference to specific exemplifying embodiments thereof, many different alterations, modifications and the like will become apparent for those skilled in the art.

It is to be understood that the present invention is not limited to the embodiments described above and illustrated in the drawings; rather, the skilled person will recognize that many changes and modifications may be made within the scope of the appended claims.

The invention claimed is:

1. A paver machine comprising:

a screed arranged to level out road material disposed on the ground;

a pressure actuated screed lifting cylinder arranged to lift and lower the screed with respect to the ground;

a pressure sensor arranged to measure the pressure in the cylinder when the screed is being lifted or lowered;

a control unit configured to:

receive pressure data from the pressure sensor indicative of the pressure in the screed lifting cylinder when the screed is being lifted by the screed lifting cylinder;

determine a variation in at least a portion of the pressure data indicative of a pressure variation in the screed lifting cylinder; and when the variation is determined to be within a predetermined stability variation threshold for a predetermined time duration, set a reference height position for the screed based on the present position of the screed.

2. The paver machine according to claim 1, wherein the control unit is configured to:

determine the variation in the pressure data in response to that an increase in pressure has been detected in the pressure data, the increase in the pressure is indicative that the screed is being lifted off the ground.

3. The paver machine according to claim 1, wherein the pressure sensor is arranged on a piston rod side of the pressure actuated screed lifting cylinder.

4. The paver machine according to claim 1, wherein the stability variation threshold corresponds to about 10 bar.

5. The paver machine according to claim 1, wherein the pressure actuated screed lifting cylinder is a hydraulic cylinder, wherein the pressure sensor is integrated with the screed lifting hydraulic cylinder.

6. The paver machine according to claim 1, further comprising a memory storage device, wherein the control unit is configured to store the reference height position in the memory storage device.

7. The paver machine according to claim 1, comprising:

a first pressure actuated screed lifting cylinder and a second pressure actuated screed lifting cylinder, each of the pressure actuated screed lifting cylinders has an associated pressure sensor, wherein the control unit is configured to determine a variation in pressure data for each of the pressure actuated screed lifting cylinders to thereby set a reference height position for the screed.

8. The paver machine according to claim 1, wherein the pressure actuated screed lifting cylinders are arranged at the rear of the paver machine.

9. The paver machine according to claim 1, wherein the paver machine is a tracked paver.

10. The paver machine according to claim 1, wherein the reference height position is a zero height for the screed indicative of the screed height position when the screed is in contact with the ground.

11. A paver machine comprising:

a screed arranged to level out road material disposed on the ground;

a pressure actuated screed lifting cylinder arranged to lift and lower the screed with respect to the ground;

a pressure sensor arranged to measure the pressure in the cylinder when the screed is being lifted or lowered;

a control unit configured to:

receive pressure data from the pressure sensor indicative of the pressure in the screed lifting cylinder when the screed is being lowered by the screed lifting cylinder;

determine a variation in at least a portion of the pressure data indicative of a pressure variation in the cylinder; and when the variation is determined to exceed a variation threshold, set a reference height position for the screed based on the present position of the screed.

12. The paver machine according to claim 11, wherein the variation is a variation in the pressure data between a stabilized pressure and a decrease in pressure, the variation being indicative of the screed touching the ground.

13. The paver machine according to claim 11, wherein the pressure actuated screed lifting cylinder is a hydraulic cylinder, wherein the pressure sensor is integrated with the screed lifting hydraulic cylinder.

14. The paver machine according to claim 11, further comprising a memory storage device, wherein the control unit is configured to store the reference height position in the memory storage device.

15. The paver machine according to claim 11, wherein the paver machine is a tracked paver.

16. The paver machine according to claim 11, wherein the reference height position is a zero height for the screed indicative of the screed height position when it is in contact with the ground.

17. The paver machine according to claim 11, comprising:

a first rear pressure actuated screed lifting cylinder and a second pressure actuated screed lifting cylinder, each of the pressure actuated screed lifting cylinders has an associated pressure sensor, wherein the control unit is configured to determine a variation in pressure data for each of the pressure actuated screed lifting cylinders to thereby set a reference height position for the screed.

18. The paver machine according to claim 17, wherein the pressure actuated screed lifting cylinders are arranged at the rear of the paver machine.

19. A method for height calibration of a screed of a paver machine, the paver machine comprising a pressure actuated screed lifting cylinder arranged to lift and lower the screed with respect to the ground, wherein the method comprises:

receiving an indication that the screed is being lifted off the ground, collecting pressure data indicative of the pressure in the screed lifting cylinder when the screed is being lifted by the screed lifting cylinder;

determining a variation in at least a portion of the pressure data indicative of a pressure variation in the cylinder; and when the variation is determined to be within a predetermined stability variation threshold, setting a reference height position for the screed based on the present position of the screed.

20. The method according to claim 19, characterized by further comprising:

based on the pressure data, detecting a pressure increase for determining that the screed is being lifted off the ground before determining the variation in the pressure data.

* * * * *